US007195583B2

(12) United States Patent
Leib

(10) Patent No.: US 7,195,583 B2
(45) Date of Patent: Mar. 27, 2007

(54) POSTURE AND EXERCISE SEATING

(76) Inventor: Roger K. Leib, 1072 S. Crescent Heights Blvd., Los Angeles, CA (US) 90035

( * ) Notice: Subject to any disclaimer, the term of this patent is extended or adjusted under 35 U.S.C. 154(b) by 502 days.

(21) Appl. No.: 10/851,916

(22) Filed: May 21, 2004

(65) Prior Publication Data

US 2005/0272582 A1 Dec. 8, 2005

(51) Int. Cl.

| | |
|---|---|
| ***A63B 22/04*** | (2006.01) |
| ***A63B 22/06*** | (2006.01) |
| ***A63B 69/16*** | (2006.01) |
| ***A47C 1/02*** | (2006.01) |
| ***A61G 15/00*** | (2006.01) |

(52) U.S. Cl. ..... 482/52; 482/57; 297/68; 297/75; 297/83

(58) Field of Classification Search ..... 482/52, 482/57, 142, 121, 123, 125, 56; 297/68, 297/354.11, 423.26

See application file for complete search history.

(56) References Cited

U.S. PATENT DOCUMENTS

| | | | | |
|---|---|---|---|---|
| 2,885,617 | A | 5/1959 | Kast et al. | 318/128 |
| 4,350,243 | A | 9/1982 | Weyandt | 198/769 |
| 4,441,060 | A | 4/1984 | Hamer et al. | 318/114 |
| 4,489,982 | A | 12/1984 | Morrow | 297/458 |
| 4,595,234 | A | 6/1986 | Kjersem | 297/258 |
| 4,838,547 | A | 6/1989 | Sterling | 272/134 |
| 4,921,247 | A | 5/1990 | Sterling | 272/136 |
| 4,981,325 | A | 1/1991 | Zacharkow | 297/284 |
| 5,178,591 | A | 1/1993 | Lyons | 482/52 |
| D340,269 | S | 10/1993 | Stevens | D21/191 |
| 5,282,748 | A * | 2/1994 | Little | 434/254 |
| 5,308,300 | A | 5/1994 | Chino et al. | 482/52 |
| 5,393,280 | A * | 2/1995 | Haviv | 482/56 |
| 5,470,298 | A | 11/1995 | Curtis | 482/130 |
| 5,501,476 | A * | 3/1996 | Howell et al. | 280/230 |
| 5,569,138 | A | 10/1996 | Wang et al. | 482/130 |
| 5,577,811 | A * | 11/1996 | Ogg | 297/452.15 |
| D380,242 | S | 6/1997 | Wang et al. | D21/195 |
| 5,690,594 | A | 11/1997 | Mankovitz | 482/121 |
| 5,735,574 | A | 4/1998 | Serber | 297/284.4 |
| 5,746,684 | A | 5/1998 | Jordan | 482/62 |
| 5,848,955 | A * | 12/1998 | Gooch et al. | 482/57 |
| 5,865,297 | A | 2/1999 | Chiba et al. | 198/751 |

(Continued)

FOREIGN PATENT DOCUMENTS

| | | |
|---|---|---|
| WO | WO 84/04689 | 12/1984 |

(Continued)

*Primary Examiner*—Stephen R. Crow
*Assistant Examiner*—Arun Chhabra
(74) *Attorney, Agent, or Firm*—Jeffrey G. Sheldon; Sheldon Mak Rose & Anderson

(57) ABSTRACT

Seating that provides comfort, facilitates healthful upright posture, has capability for exercise, and facilitates a healthful upright position, comprises a seat having left and right portions for supporting a user's left and right thighs, respectively. A seat support supports the seat. The seat support includes a pivot axis about which the seat left and right portions can pivot downwardly and upwardly relative to the seat support. A foot plate assembly comprises right and left foot support members positioned forwardly and below the seat to allow a user to exercise while seated. A connection structure links the foot plates to the seat so that the seat sections and the foot members have corresponding movement.

30 Claims, 7 Drawing Sheets

U.S. PATENT DOCUMENTS

| | | | | |
|---|---|---|---|---|
| 5,897,459 | A * | 4/1999 | Habing et al. | 482/53 |
| 5,971,893 | A | 10/1999 | Johnston | 482/57 |
| 6,120,416 | A * | 9/2000 | Walker | 482/57 |
| 6,183,403 | B1 | 2/2001 | Dunn | 482/121 |
| 6,261,213 | B1 | 7/2001 | Frey | 482/121 |
| 6,368,260 | B1 | 4/2002 | Crews | 482/142 |
| 6,379,285 | B1 | 4/2002 | Maresh et al. | 482/57 |
| 7,090,303 | B2 * | 8/2006 | Kropa | 297/466 |
| 2004/0100137 | A1 * | 5/2004 | Johnson | 297/423.26 |

FOREIGN PATENT DOCUMENTS

| | | |
|---|---|---|
| WO | WO 84/04690 | 12/1984 |

* cited by examiner

POSTURE AND EXERCISE SEATING

BACKGROUND

A common problem with a sedentary lifestyle is inadequate exercise. Sitting in an office for eight hours or more a day interferes with an opportunity to obtain exercise. Moreover, most seating is not designed for good posture. The combination of inadequate exercise and poorly designed seating can result in backaches, headaches and other physical ailments, including obesity, diabetes and cardiovascular problems.

Thus, there is a need for seating that encourages good posture and provides an opportunity to exercise, even while working at a desk.

Efforts have been made to improve the posture enabled by seating, and efforts have been made to provide exercise while in a seated position. See, for example, U.S. Patents D340269; D380,242; U.S. Pat. Nos. 2,885,617; 4,350,243; 4,441,060; 4,489,982; 4,595,234; 4,838,547; 4,921,247; 4,981,325; 5,470,298; 5,569,138; 5,577,811; 5,690,594; 5,735,574; 5,746,684; 5,865,297; 5,971,893; 6,183,403; 6,261,213; 6,368,260; and 6,379,285; and PCT documents WO 84/04690, and WO 84/04689.

In spite of these efforts, there remains a need for practical improved seating that encourages good posture and provides an opportunity for exercise.

SUMMARY

Seating according to the present invention satisfies this need. Exemplary seating comprises a seat, a seat support, optionally a back support assembly, and an exercise foot assembly. The seat can have left and right portions for supporting a user's left and right thighs, respectively. The seat support includes a pivot axis about which the left and right portions can pivot downwardly and upwardly relative to the seat support, such as by a hinge assembly. The exercise assembly comprises left and right foot supporting members positioned forwardly and below the seat to allow user to exercise while seated. There is a connection structure tying the exercise assembly to the seat and/or seat support, and linking the right foot member to the right portion of the seat and a left foot member to the left portion of the seat, so that when a user causes the right foot member to move upwardly or downwardly the right portion of the seat pivots correspondingly, and when a user causes the left foot member to move upwardly or downwardly, the left portion of the seat pivots correspondingly. Preferably the foot members are pivotably mounted to move through a predetermined angle.

The seat optionally can have a rear section that does not pivot. The distance between the foot exercise assembly and the seat can be made adjustable to accommodate users of different leg length.

The back support assembly can comprise a mount extending upwardly and having a generally longitudinal axis, a lower back support, and an upper back support. The lower back support can comprise two back pads, where the lower back pads can be supported by a cross-beam pivotally attached to the mount, with each pad independently pivotal on the cross-beam, with the result that each lower back support is limitedly rotatable about the mount axis and about a second axis perpendicular to the mount axis.

The back mount can be pivotally attached to the understructure so it can tilt rearwardly.

Thus, the seating, with a tilting back support assembly, movable lower pads and the foot stop assembly is very comfortable, encouraging good posture while seated, and provides an opportunity for seated exercise.

DRAWINGS

These and other features, aspects, and advantages of the present invention will become better understood from the following description, appended claims and accompanying drawings where:

Figure 1:
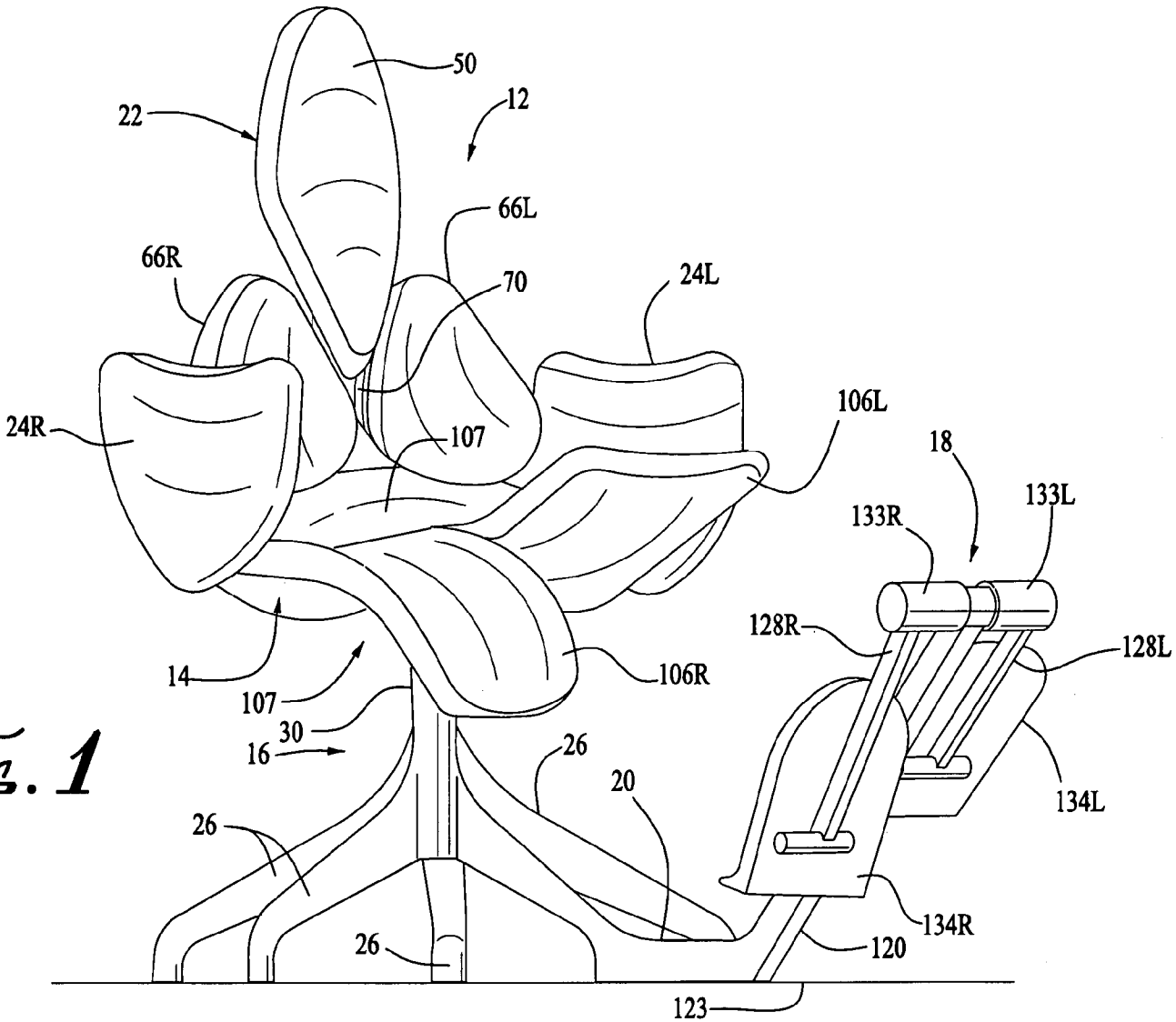
FIG. 1 is a perspective view of seating having features of the present invention, including a seat having movable left and right front seat segments, and an exercise foot assembly having foot members, wherein the foot members are in a first position.
Figures 4, 5:
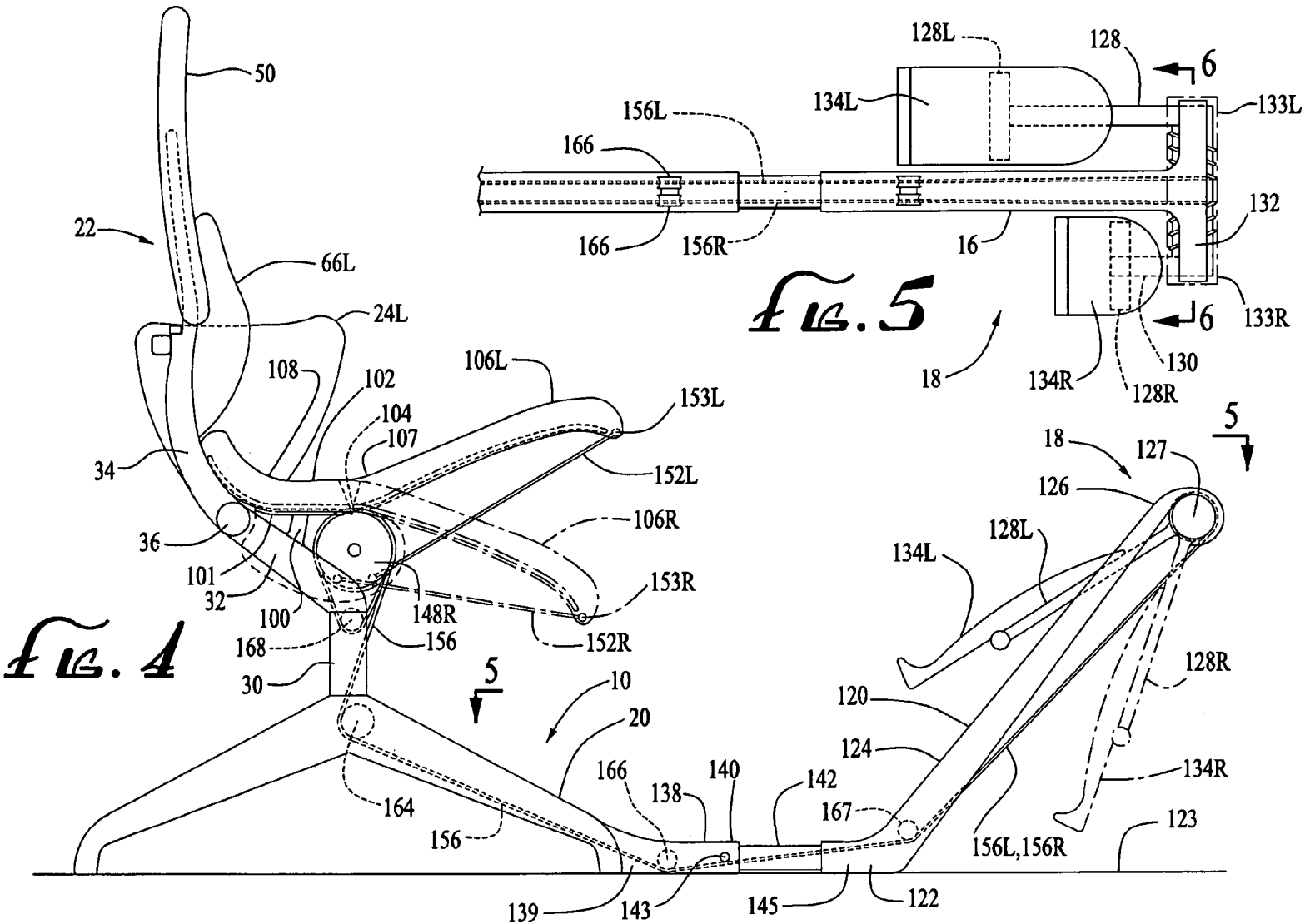
Figure 6:
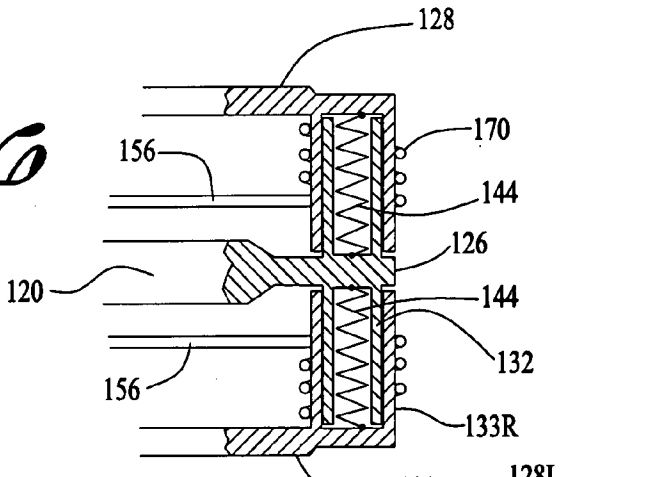
Figure 7:
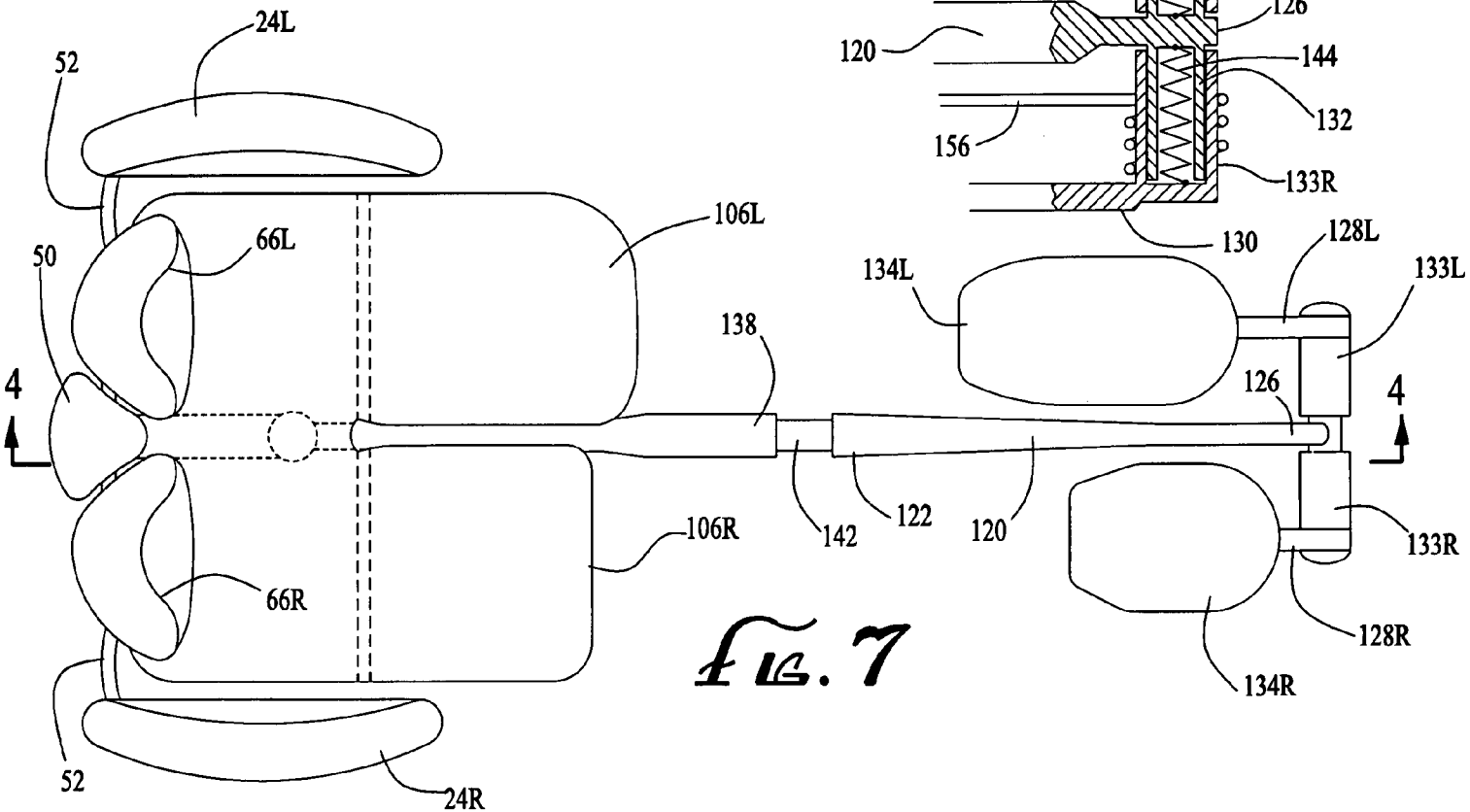
Figure 8:
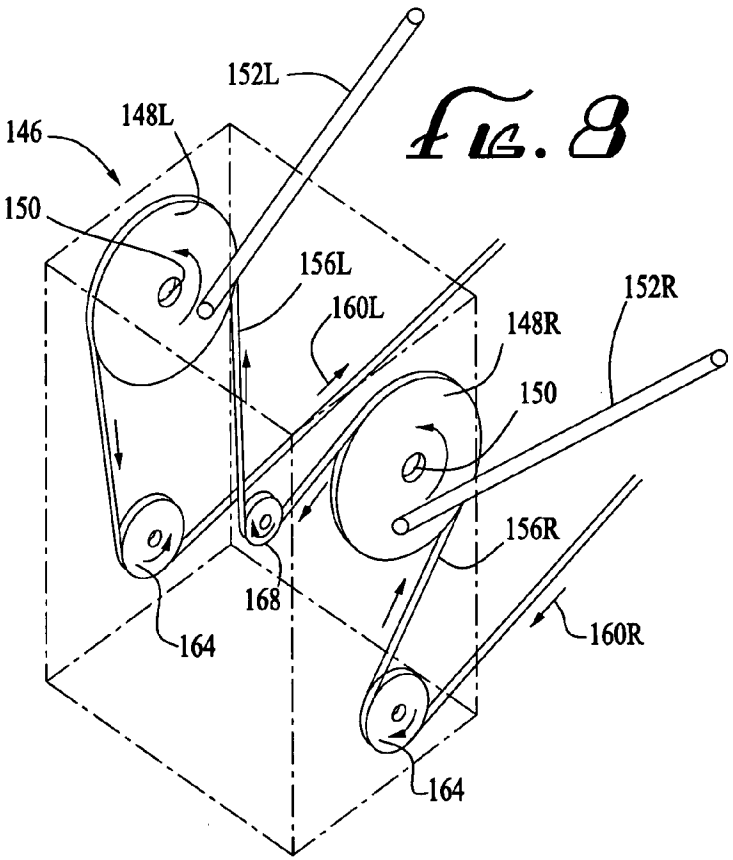
Figure 9:
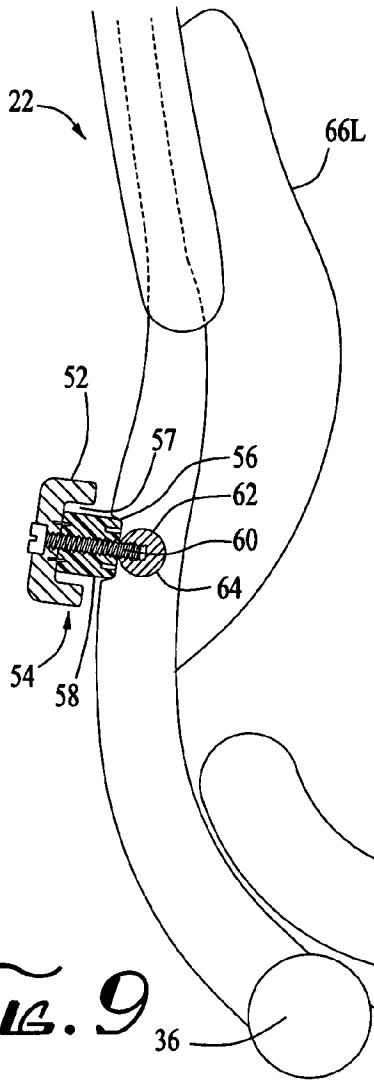
Figure 11:
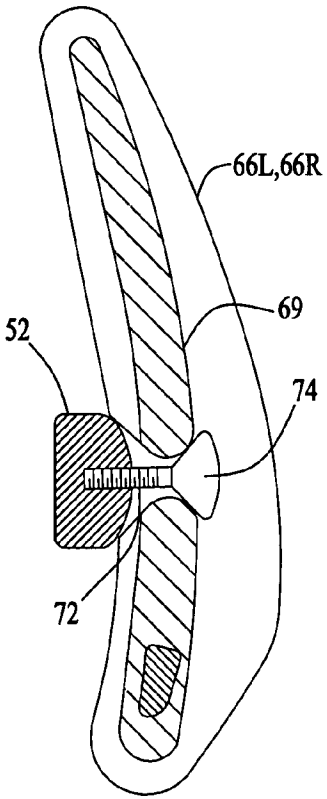
Figure 10:
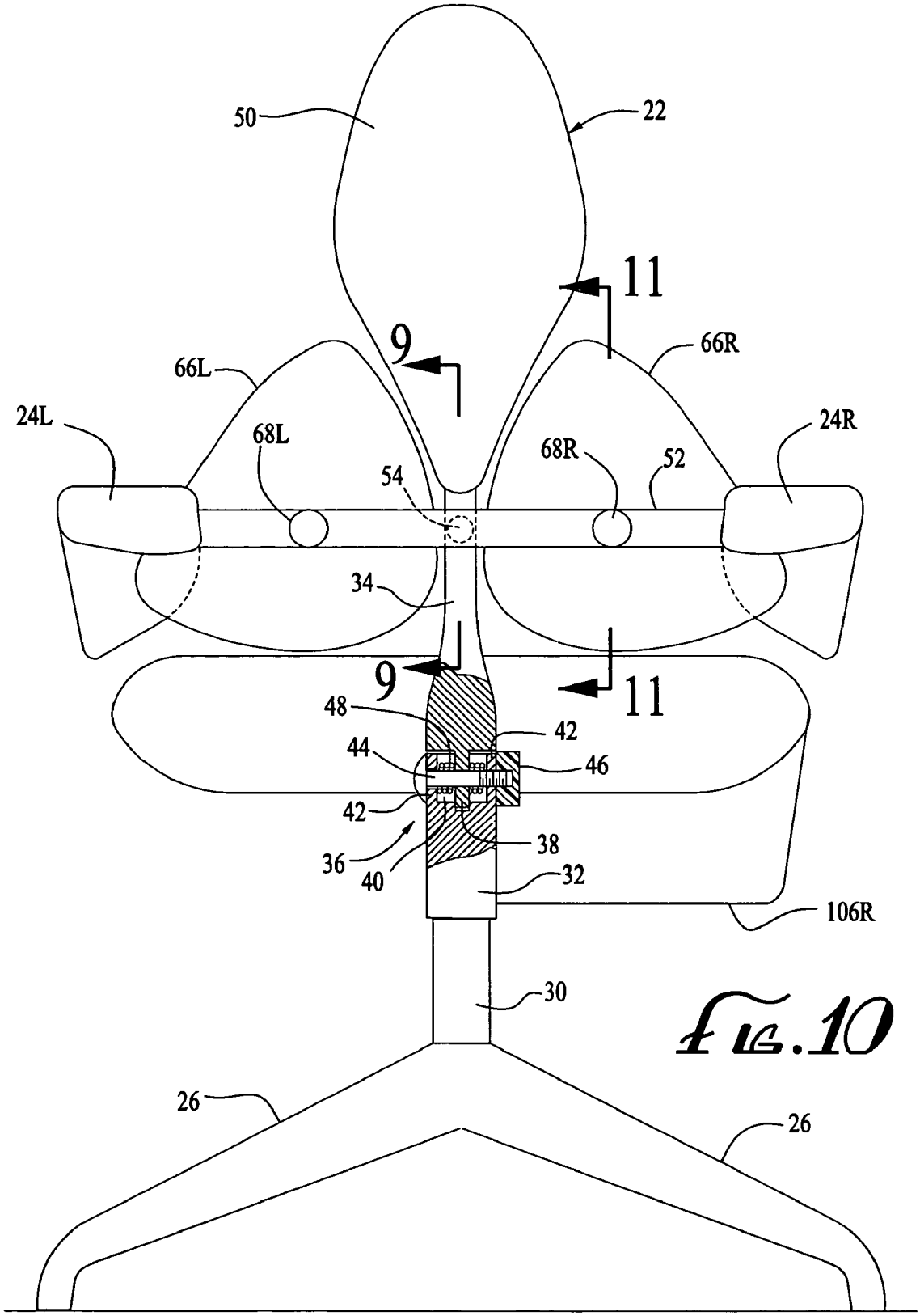
Figure 12:
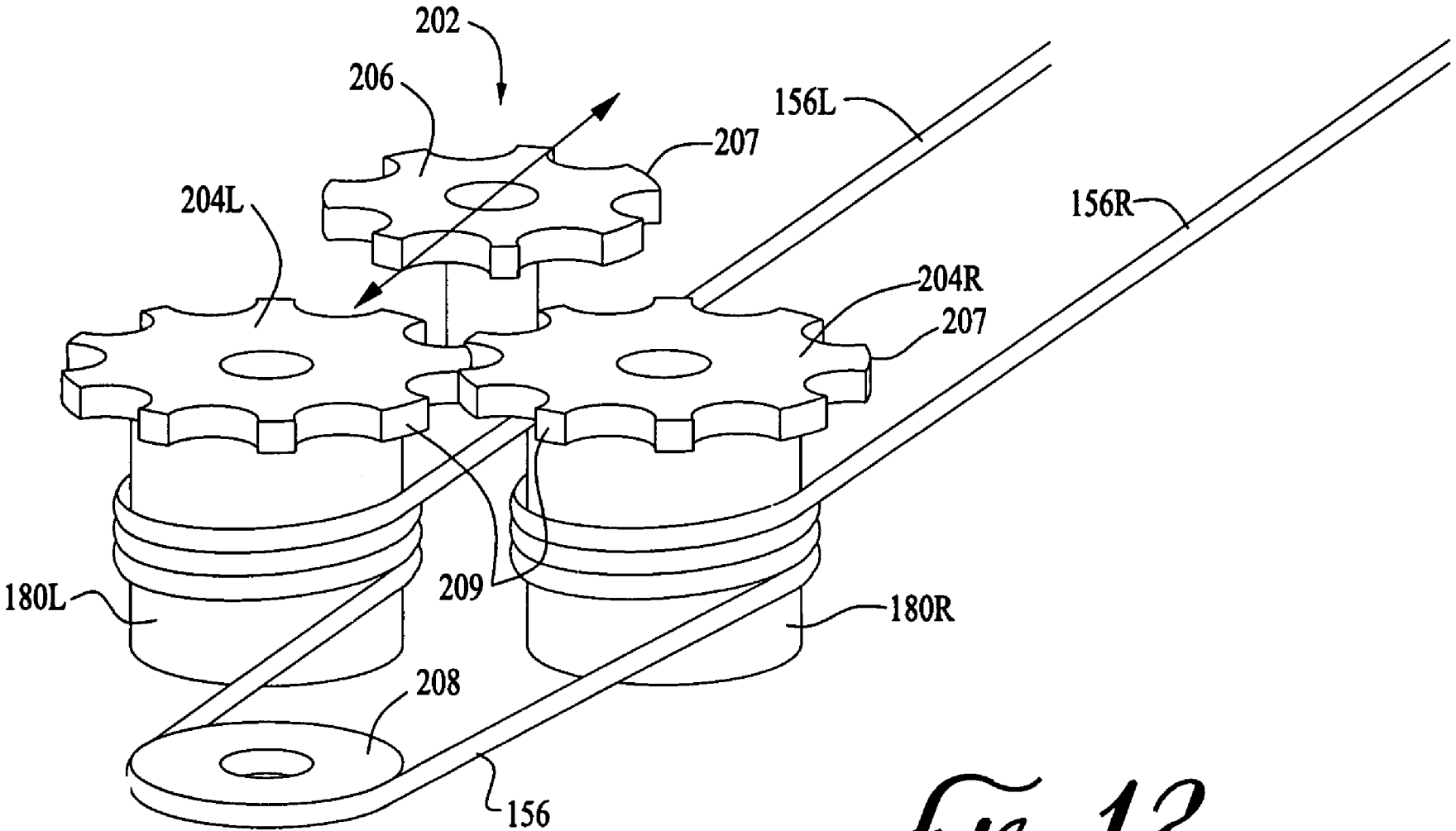

FIG. 4. is a side elevation view of the seating of FIG. 1 schematically showing elements of a mechanical system embodying features of the present invention;

FIG. 5 is a top plan view of a portion of the seating of FIG. 1 taken on line 5—5 in FIG. 4;

FIG. 6 is a sectional view of the foot exercise assembly taken on line 6—6 in FIG. 5;

FIG. 7 is a top plan view of the seating of FIG. 1;

FIG. 8 is a schematic, perspective view of the mechanism that moves the seat fronts in FIG. 1;

FIG. 9 is a side elevation view, partly in section, of the seating of FIG. 1;

FIG. 10 is a rear elevation view of the seating of FIG. 1, with a portion shown in section;

FIG. 11 is a partial sectional view taken on line 11—11 in FIG. 10; and FIG. 12 schematically shows a system for fixing or adjusting the relative position of the foot members, both to one another, and to the movable seat fronts.

DESCRIPTION

Seating according to the present invention can be a chair or other structure such as a couch, settee, bench, or the like. The seating can comprise a seat assembly supported atop an understructure, also referred to as a base assembly, which is optionally connected structurally to an adjustably distanced exercise foot assembly via an extensible connecting assembly. A back assembly adjoins the base assembly below the seat assembly. Left and right arm assemblies adjoin the back assembly. The exercise foot assembly can comprise foot pedals that can have resistive reciprocating movement or circular bike-pedal movement for seated exercise.

Seating embodying elements of the present invention can have one or more of the features specified below. It is not necessary that the seating have all the features described below with regard to the specific embodiments of the invention shown in the figures.

With reference to the figures, a chair 12 comprises a seat assembly 14 supported on an understructure 16, which is connected to an adjustably spaced apart foot stop assembly 18, also referred to as a foot plate assembly and an exercise foot assembly. This is effected through a connecting assembly 20 whose length is adjustable. A back assembly 22 is connected to the understructure 16 below the seat assembly 14. Optional left and right arm supports 24L and 24R can adjoin the back assembly 22. No arm rest need be used, or different styles of arm rests can be used.

The understructure 16 comprises four legs 26 bilaterally symmetrically spaced apart and joined together at their uppermost portions to a central, generally vertically oriented, tubular supporting central column 30. The legs 26 can be provided with wheels, which can be retractable. The present invention is not limited to the understructure 16 shown in the drawings. It can be any understructure used in conventional seating that support the seat portion and back portion. For example, the understructure need be no more than a single support bar such as in a LA-Z-BOY™ type chair, where the seat is supported by a lateral bar supported by two side panel arm structures.

As best seen in FIG. 4, the back assembly 22 comprises a fixed lower back stem 32 or mount which is rigidly and securely mounted on top of the central column 30. The back stem 32 extends in a direction rearwardly and upwardly from the central column 30, and is optionally integral with, or attached to the central column 30, such as by welding. The back assembly 22 also comprises an upper back stem 34, also referred to as an upper back support or mount, which is attached to the lower back stem 32 at a torsionally adjustable pivot point 36. This allows the upper back stem 34 to decline rearwardly from the pivot point 36 with adjustable tension.

The upper back stem 34 is laterally centrally positioned to provide optimum back support. The upper back stem 34 has a generally longitudinal axis, and extends generally vertically, with built-in curvature corresponding to a user's spine to provide good back support, rounding forwardly in the region of the central back of the user.

As shown in FIG. 10, at the pivot point 36 a downwardly extending tongue 38 of the upper back stem 34 extends into a space 40 between two upwardly extending arms 42 of the lower back stem 32, and is held in place by a fastener system that can comprise a bolt 44 and a lock nut 46. The pivot point 36 provides a horizontal pivot axis at a height below the seat assembly 14 so the mount can tilt rearwardly. An adjustable torsion spring 48 can be used to adjustably control the amount of force required to cause the upper back stem 34 to pivot. Thus, a user is able to decline and return to a more upright position according to rearward pressure from the user's back.

The upper back stem support 34 terminates in a cushioned upper back rest 50, which can comprise a structural framework such as wood or plastic encased by a cushioning means, such as polyurethane foam, which can be covered with any material conventionally used in seating, such as vinyl, fabric or leather. Preferably the padded central upper back support 50 is shaped so as not to constrain rearwardly the user's shoulders, thereby leaving the user's arms free to hang straight down from the shoulders.

The back assembly 22 can also comprise a cross-beam 52 pivotally attached to the upper back stem 34 at a connection point 54 so that the cross-beam 52 can pivot relative to the vertical upper back stem 34. With reference to FIG. 9, pivoting is effected with a hollow region 56 in the upper back stem 34 and a corresponding hollow 57 in the cross-beam 52 so that the cross-beam 52 has a "C"-shaped configuration in this region. A resilient bushing 58 is in the hollow 57. The resilient bushing 58 can be made of urethane rubber. A fastener such as a bolt 60 projects through the cross-beam 52 and the bushing 58, and is threaded into a spherical nut 62 that is mounted to pivot in a hollowed out portion 64 in the front of the upper back stem 34 to accommodate omni-directional movement.

Left and right pivoting cushioned lower back rest support pads 66L and 66R are attached to the cross-beam 52 at attachment locations 68L and 68R, respectively (See FIG. 9). These cushions are located at about lower lumbar height extending to about the kidney area of the user. They project forwardly of the central upper back support 34, effecting a vertical hollow space or region 70 between the pads 66L and 66R in which the protruding vertebrae of the user can comfortably fit without concentration of pressure. The attachment locations 68L and 68R are about midway in the height of the support pads 66L and 66R slightly above the center of gravity of the support pads 66L and 66R. Attachment is effected with a tapered head 74 countersunk fastener 72 engaging a tapped hole in cross bar 52 for each lower back support 66L and 66R.

Each lower back support 66L and 66R can comprise a structural frame shell structure 69 of wood or plastic, for example, enclosed in a material covered cushioning means such as foam padding, for example. The cover can be vinyl, leather or fabric. The frame structure 69 of each pad is free to pivot in any direction about the pivotable counter sunk fastener 72. Preferably, the cushioning or frame shell structure 69 of each lower back support pad 66L and 66R is counter-weighted to maintain the pads in a normal non-tilted orientation such as shown in FIG. 1.

The pivotal attachment of the cross-beam 52, and the pivoted attachment of the cushioned lower back rest supports 66L and 66R, allow the pair of back rest supports 66L and 66R to move reciprocally in and out, up and down, and parallel to the position of a user's back as the user pedals or reciprocates a pair of foot plate members, as described below. The pivoting motion of the lower back supports 66L, 66R keeps each lower back support parallel to and flat against the user's lower back, and accommodates twisting motion of the user's lower back, while providing good back support.

The cross-member 52 supports at its ends longitudinally past the pivot points 68L and 68R the arm rests 24L and 24R, respectively.

The seat assembly 14 comprises a seat support stem 100 that extends upwardly from the lower back stem 32, supporting a seat support plate 101. Mounted on the seat support plate 101 is a rear seat segment 102. A hinge assembly 104 attached to the rear seat assembly 102 supports independently movable left and right front seat segments 106L and 106R so they can pivot about a horizontal pivot axis corresponding to the functional axis of the pin of hinge means 104. The hinge assembly 104 can comprise a back plate attached to the rear segment 102 with two forward plates, one attached to each front segment 106, or can be two separate hinge means, each having a rear plate attached to the rear segment 102 and another plate attached to a respective one of the front segments 106. Each of the rear segment 102, left front segment 106L and right front segment 106R is made of an adequately rigid structure such as of wood or plastic composite enclosed by foam or other cushioning means that is encased by a material such as fabric, vinyl, leather or other covering means. Left front 106L and right front 106R seat segments can pivot upwardly or downwardly, rising and falling. The rear seat assembly 108 in combination with the front seat segments 106L and 106R forms a seat 107 for the user.

The foot pedal portions of the exercise foot assembly 18 are in front of and below the seat assembly 14. The user, by pushing against the exercise foot assembly 18, can apply a rearwardly, axial force along the user's legs, maintaining the user's pelvis back in the seat. This action, in conjunction with a proper back rest, keeps the user's pelvis in a forward-tipped position, which effectively maintains a desirable spinal S-curve, which provides good posture and comfort in seating and minimizes the amount that the elbow and arms must be used in supporting the shoulders and upper body of a user. Having both legs extended nearly straight against the exercise foot assembly 18 creates a stable, sustainable mechanical "toggle" position which can be comfortably maintained for long periods of time without leg muscle fatigue.

The foot exercise assembly 18 comprises a support member 120 having a foot portion 122 for placement on a support surface such as a floor 123 and a long leg portion 124 that extends upwardly and forwardly from the foot portion 122. At the uppermost end 126 of the leg portion 124 is an axle 127 that supports right and left foot bars 128R and 128L, which are hinged rotatably so that they travel in a reciprocating fashion independently relative to one another through a predetermined angle. In another embodiment, right and left foot bars 128R and 128L rotate around the axle 127 as in a bicycle motion. A forward end of each foot bar 128R and 128L comprises a pair of cylindrical housings 133R and 133L that slide over the axle 127 supported at the forwardmost end of the main support member 120. Each foot bar 128L and 128R supports a corresponding foot member 134L and 134R, for receiving a user's feet. The foot members can be plates, as shown in the figures, or can be such elements as bicycle pedals.

The connecting assembly 20 comprises a connecting bar 138 attached at a first end 139 to the support structure 10. At the opposed second end 140 is an adjustment bar 142 sized to telescopically slide into at least one of (i) the connecting bar 138, and (ii) a hollow horizontal extension 145 of the foot segment 122 of the support member 120. Thus, the distance of the exercise foot assembly 18 from the seat assembly 14 is adjustable by varying the amount the adjustment bar 142 is slid into the connecting bar 138 and/or the leg 124. Thus, the distance between the exercise foot assembly 18 and the seat assembly 14 is telescopically adjustable with a first telescoping mechanism to accommodate users with different leg lengths. The distance can be fixed by a mechanical, hydraulic, pneumatic or other means. For example, a selected distance can be fixed by means of a pin 143 inserted through holes (not shown) in mating positions in the adjustment bar 142 and the connecting bar 138.

Optionally, the support 120 can be made into multiple segments, where the length can be made adjustable using the same type of telescoping mechanism. This can be used in addition to the first telescoping adjustment so that not only the distance between the exercise foot assembly 18 and the seat assembly 14 can be adjusted, but the relative elevation between the foot plates 134L, 134R and the seat assembly 14 can be adjusted.

Adjustment of the distance between the foot exercise assembly 18 and the rear portion of the seat assembly 14 not only accommodates variations of leg length of individual users pushing against the exercise foot assembly 18 so as to impose a rearwardly axial force along the user's femurs, but it also serves to position the user's pelvis toward the back of the seat assembly so it is tipped forwardly from its top to properly align the spine into an S-shaped curve. This is most readily done by locating the foot plates 134L and 134R forwardly and downwardly of the seat assembly 14 so that the thighs of the user extend downwardly, thereby imposing a healthy rotation on the pelvis.

Figure 3:
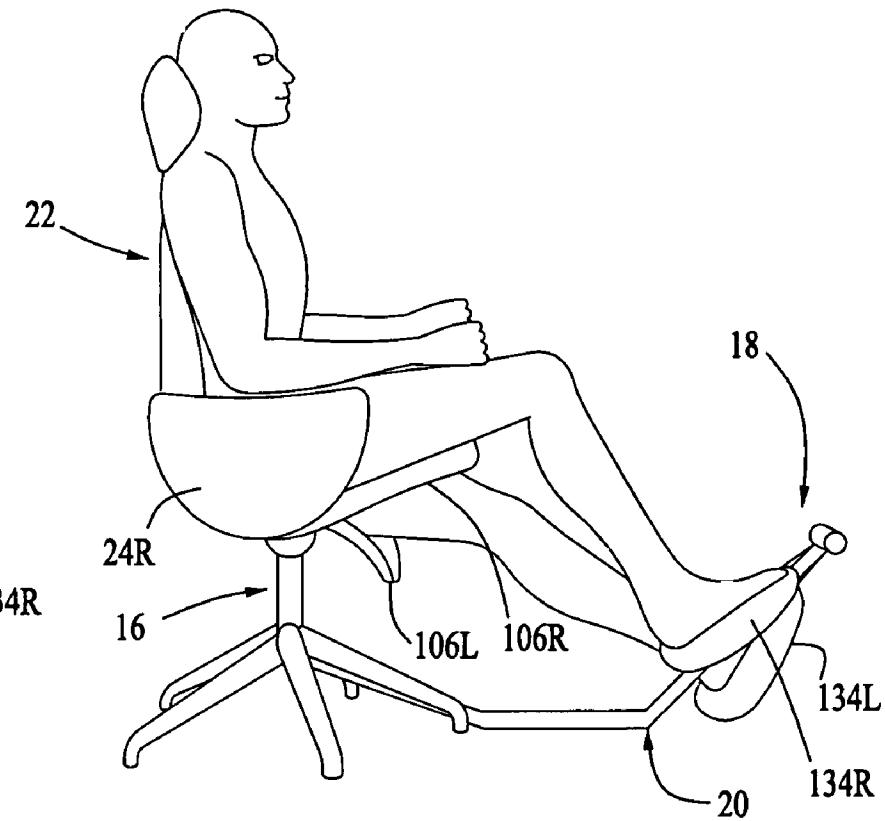
FIGS. 2 and 3 are side elevational views of the seating of FIG. 1 with the foot members in second and third positions, respectively.

Resistance to rotation of the foot bars 128R and 128L and thus movement of the foot plates 134L, 134R can be provided by a mechanical, hydraulic, or pneumatically adjustable mechanism. For instance, a torsional spring 144, as shown in FIG. 6, can be used for resistance to rotational motion imposed by downward and forward motion of foot plates 134R and 134L. The spring 144 causes the foot bars 128L and 128R to be biased towards an "up" position. The left foot plate 134L is shown in an "up" position and the right foot plate 134R is shown in a "down" position in FIG. 1. The foot plates are shown in the reverse position in FIG. 3, and the foot plates are shown in an intermediate position in FIG. 2.

An optional, but desirable feature of the present invention, is to coordinate the reciprocating motion of the front seat segments 106L, 106R with that of the foot plates 134L, 134R, respectively. This can be effected with a connection assembly 146 as shown in FIG. 8. The connection assembly 146 comprises left and right spools 148L, 148R rotatably mounted on a horizontally extending axle 150 which is supported at the junction of the central column 30 and the lower back stem 32. A rigid right strut 152R rotatably hinged at each end connects the right spool 148R to the front 153R of the right seat segment 106R. Likewise, a similarly rigid and rotatably hinged left strut 152L connects the left spool 148L to the front 153L of the left seat segment 106L. Wrapped around each spool 148R, 148L is a cable 156 having two ends, each wrapped around and attached to respective cylindrical housings 133R and 133L via a set of first 164, second 166, and third 167 pulleys. Between the spools 148 is a pulley 168 for the cable 156.

When a user pushes forwardly and downwardly on the foot plates 134L, 134R, connecting bars 128L and 128R rotate cylindrical housings 133L and 133R, alternately tensioning cable 156 ends and causing the corresponding seat segments 106L, 106R to tilt downwardly. For example, as shown in FIG. 4, the right foot plate 134R is in a downward position, and accordingly, the right seat segment 106R has its front portion tilted downwardly. This pulls the opposite left end of cable 156, causing the left foot plate 134L to raise to its "up" position, and correspondingly, the left front seat segment 106L is tilted upwardly. Movement of the left foot plate 134L downwardly results in the cable 156 moving in a direction shown by arrows in FIG. 8, with the result that the front 153L of the left front seat segment 106L has its front tilt downwardly, the right foot plate moves upwardly and the front 153R of the right seat segment 106R tilts upwardly.

The movement of the paired foot plates 134L and 134R is designed to provide reciprocal resistance, and thus large muscle exercise, to a user sitting in the chair pushing the user's feet against the foot plates 134L, 134R. Resistance can be constant, or can be varied by any variety of a hydraulic, or pneumatic adjustment device. For example, as shown in FIG. 6, this can be provided by adjustably torsionable resistance springs 170.

The corresponding reciprocating tilting of the front of the seat segments minimizes under-thigh pressure on a user's legs. Such pressure can compromise blood circulation. Also, the alternating incline of the front seat segments 106L, 106R helps keep the user's pelvis tucked back into the rear seat portion.

Rather than using cable 156 for coordinating the motion of the foot plates and the seat segments, hydraulic or pneumatic cylinders can be used.

The chair 12 can include a locking assembly to prevent movement of the seat segments, such as a removable pin locking aligned holes in the seat segments (not shown).

It is desirable that the length of the cable 156 be adjustable, to allow (i) adjustment of the height and orientation of the seat; (ii) the distance between the foot stop assembly 18 and the seat assembly 14; and (iii) the parallel alignment of foot plates at the tops or bottoms of their strokes. These adjustments requiring changes to the length of cable 156 can be accommodated with a pair of take-up pulleys 180 and the structure shown in FIG. 12, as described below.

Figure 2:
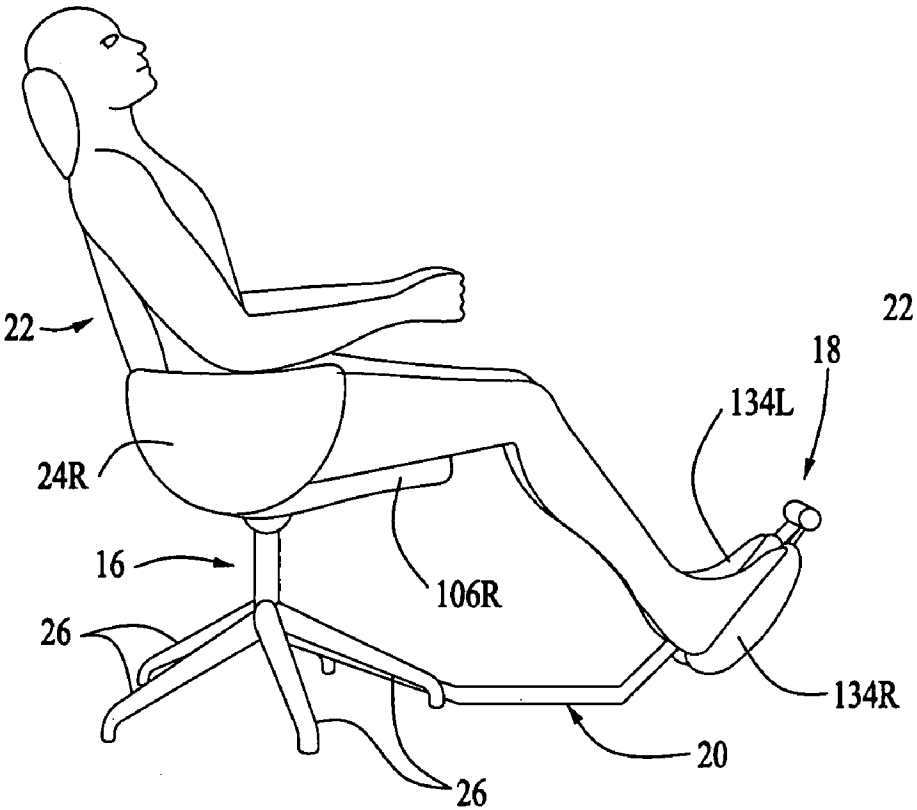

In a non-exercise mode of the chair 12, the user can push both foot plates 134L, 134R into their lowest "toggle" position, as shown in FIG. 2, thereby tilting both seat fronts down and forcing the user's pelvis rearwardly into the back of the chair. A locking mechanism, as described below with regard to FIG. 12. can be provided to allow the foot plates 134 and 136 to assume a fully depressed parallel position, or any other desired position, so the user does not have to exert force to maintain a selected position.

A user can tilt the upper back support 50 rearwardly while having one or both of the seat fronts raised, to provide a comfortable reclined position as is customary in tilt office furniture. Optionally, for a non-exercise mode, the same postural advantages can be achieved by a single unified foot support that is either fixed or variably distanced from lowered seat fronts.

FIG. 12 shows a cable adjustment system 202 that (i) allows for the adjustment of the distance between the exercise foot assembly 18 and the seat 107, (ii) permits raising, lowering and swiveling of the seat 107, and (iii) allows the two foot plates 134 to be together (parallel) at the top and bottom of their up and down movement (travel). This system 202 allows the cables 156 to be taut and lengthened or shortened as the need occurs. The cable adjustment system 202 can be controlled by the user and is easily accessible by the user. This optional cable adjustment assembly 202 can be placed beneath the seat 107. With reference to FIG. 12, it can comprise a pair of take-up spools 204, a locking gear 206, and a movable key spool 208. The assembly 202 can be interposed between the large spools 148L and 148R or in a location immediately below them.

The opposing take-up spools 204 are provided with an extra length of cable 156. Each take-up spool has a geared portion 207 and is arranged so that a user can cause them to move together to a contact position causing gear teeth 209 to interlock so that they rotate in opposite directions. In this position, extending one end of cable 156 causes the opposite end to retract, so pedals and seat fronts reciprocate together. Alternatively, the take-up spool can be moved apart, so that the gear teeth 209 are apart and the spools 204 can rotate in the same direction with cable 156 on both spools being wound in the same direction. Both spools can have an internal biasing spring (not shown) which forces them to return to the contact position.

When a user wants to lengthen the distance of the foot plates 134, raise the seat 107 or swivel the seat 107 to the side, or have both foot plates 134 at the bottom of stroke, the two take-up spools 204 are separated so they can rotate independently. Thus, the cable 156 can wind under tension, causing the cable 156 to lengthen. After this is effected, the take-up spools 204 are re-engaged so that as one cable lengthens, the other again shortens because the take-up spools 204 are forced to rotate in opposite directions.

The movable key spool 208 is arranged to move toward or away from the take-up spools 204 in a direction perpendicular to a line between the centers of the take-up spools 204. As the movable key spool 208 moves away from the take-up spools 204, with the teeth 209 separated and thus disengaged, the cable 156 shortens so that both pedals 134 move to the top of their travel and both front seat segments 106 are tilted upwardly.

To prevent any movement of the cable, and thus to lock the foot plates 134 in a fixed position, the locking gear 206 can be moved toward both take-up spools 204 along the same line of travel as the movable key spool 208. The locking gear 206 engages the teeth 209 of both take-up spools 204, preventing any movement of the take-up spools 204, thereby effectively locking all motion of the cable.

Optionally, any or all of the take-up spools 204, movable key 208 and locking gear 206 can be variably torsioned to vary the amount of force required to reciprocate the pedals 134.

Accordingly, the present invention provides very comfortable seating with good back support that encourages healthy posture, even when being used for exercise purposes, and also provides an opportunity to perform exercise while in a seated position.

Although the features of the invention are described with regard to seating for office applications, the invention can also be useful for manual assembly-line chairs, for easy chairs, such as for television watching, a computer chair for home use, and a wheel chair for mobility use by semi-ambulatory elderly, where the reciprocating motion of the foot plates can propel a wheel chair device forwardly and backwardly.

The present invention is directed to various combinations of the aforementioned features. Seating encompassing many of these features has among its advantages the following:

- Comfort while accommodating active, health-enhancing large-muscle exercise.
- Comfortable long-duration use while performing seated tasks in the office, factory, home-office, or leisure environment.
- Promotion of a healthful sitting posture for the user.
- Support for the user to sit in an erect seated posture in such a way that the user is discouraged from unconsciously moving to a slouched posture.
- Discouragement of slouching by maintaining the pelvis of the user at the back of the seat in a forward-tipped position.
- Allowing the user to unconsciously maintain sufficiently erect posture that the elbows and upper arms do not of necessity support the upper body.
- Support of the feet off the floor so that only a single height adjustment—that of the seat—is required to bring the user into proper relationship to the work surface without compromising circulation in the legs. Height accommodation can be effected with conventional telescoping mechanisms, such as a gas cylinder in the central column 30.
- Access to adjacent work surfaces, while accommodating reasonably conventional means of ingress and egress common to office chairs, and further accommodating a range of sitting postures associated with better office chairs, namely forward tilt and recline.
- Providing active health-enhancing exercise opportunities while seated and engaging in otherwise sedentary TV- and computer-screen-oriented at-home leisure activities.
- Providing and accommodating large-muscle lower-body exercise to people whose unsteadiness and/or lack of balance consigns them to wheelchairs.

Although the present invention has been described in considerable detail with reference to certain preferred versions thereof, other versions are possible. For example, a lower back cushion can be used with closed arms, so the seating appears less like office seating, but rather more like a home over-stuffed easy chair. Moreover, the exercise foot assembly need not be physically connected to the understructure. Also, any of the cushioning 50, 66L, 66R, 102, 106L and 106R described herein can be any conventional cushioning means covered in any conventional skin, or can be flexible, transparent wire framed cushions or the like. While the preferred back rest of the invention moves and articulates as described, features of the present invention, such as the exercise features are obtainable with minimal back support, such as having elevated rearmost seat portions to limit the rear portion of a user's pelvis. Therefore, the spirit and scope of the appended claims should not be limited to the description of the preferred versions contained herein.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function, should not be interpreted as a "means" for "step" clause as specified in 35 U.S.C. § 112.

The invention claimed is:

1. Seating comprising:

a) a seat having left and right portions for supporting a user's left and right thighs, respectively;

b) a seat support for supporting the seat, the seat support including a pivot axis about which the left and right portions can pivot downwardly and upwardly independently relative to the seat support;

c) an exercise assembly comprising right and left foot elements positioned forwardly and below the seat to allow a user to exercise while seated, wherein each foot element is pivotable on its own pivot axis that is different than the pivot axis of the seat support; and d) a connection structure linking the right foot element to the right portion of the seat and the left foot element to the left portion of the seat so that when a user causes the right foot element to move upwardly or downwardly the right portion of the seat pivots correspondingly, and when a user causes the left foot element to move upwardly or downwardly, the left portion of the seat pivots correspondingly.

2. The seating of claim 1 comprising an understructure supporting the seat support.

3. The seating of claim 1 comprising a back support extending upwardly above the seat.

4. The seating of claim 3 wherein the foot elements can be maintained in a locked position to allow a user to push the pelvis of the user rearwardly into the back support.

5. The seating of claim 2 wherein the exercise assembly is connected to the understructure.

6. The seating of claim 5 wherein the exercise assembly is rigidly attached to the understructure.

7. The seating of claim 1 wherein the foot elements are mounted for reciprocating movement.

8. The seating of claim 1 wherein the connection structure is adapted so that the distance between the foot elements to and the seat is adjustable.

9. The seating of claim 2 comprising a connecting element having an adjustable length connecting the foot elements to the understructure.

10. Seating comprising:

a) a seat having a rear portion and left and right forward portions for supporting a user's left and right thighs, respectively;

b) a hinge assembly connected to the seat forward portions so that the seat left and right forward portions can pivot downwardly and upwardly independently relative to the seat rear portion;

c) an exercise assembly comprising right and left foot members positioned forwardly and below the seat to allow a user to exercise while seated, , wherein each foot member is pivotable on its own pivot axis that is different than the pivot axis of the seat support and d) a connection structure linking the right foot member to the right portion of the seat forward section and the left foot member to the left portion of the seat forward section so that when a user causes the right foot member to move upwardly or downwardly the right portion of the seat pivots correspondingly, and when a user causes the left foot member to move upwardly or downwardly the left portion of the seat pivots correspondingly.

11. The seating of claim 10 comprising a back support extending upwardly from the seat.

12. The seating of claim 10 wherein the rear portion of the seat cannot pivot relative to the understructure.

13. The seating of claim 10 comprising means for adjusting the length of a portion of the connection structure to adjust the distance between the foot exercise assembly and the seat.

14. The seating of claim 13 wherein the foot members are mounted to move downwardly and away from a user when the user pushes forwardly.

15. The seating of claim 10 wherein the two foot members are pivotally mounted to move through a predetermined angle.

16. Seating comprising:

a) an understructure;

b) a seat having a rearward section and a forward section, the seat forward section comprising left and right portions for supporting a user's left and right thighs, respectively;

c) a seat support connected to the understructure, the seat support including a pivot axis about which the left and right portions of the forward section of the seat can pivot downwardly and upwardly independently relative to the seat rearward section;

d) an exercise assembly comprising right and left foot members positioned forwardly and below the seat to allow a user to exercise while seated, wherein each foot element is pivotable on its own pivot axis that is different than the pivot axis of the seat support;

e) a connection structure linking the right foot member to the right portion of the seat forward section and the left foot member to the left portion of the seat forward section, so that when a user causes the right foot member to move upwardly or downwardly, the right portion of the seat forward section pivots correspondingly, and when a user causes the left foot member to move upwardly or downwardly, the left portion of the seat forward section pivots correspondingly; and f) a back assembly comprising (i) an elongated mount extending upwardly and having a generally vertical axis; (ii) a lower back support pivotally attached to the mount so that the lower back support is rotatable about the mount axis; and (iii) an upper back support above the lower support for supporting a user's upper back.

17. The seating of claim 16 wherein the upper back support is non-pivotable.

18. The seating of claim 16 where the lower back support comprises right and left sections pivotally attached to the mount so that the right and left sections are independently rotatable about the mount axis.

19. The seating of claim 16 wherein the lower back support comprises a pair of pads with a space therebetween into which a user's vertebrae can protrude.

20. The seating of claim 16 wherein the elongated mount can pivot relative to the seat rearwardly.

21. The seating of claim 1 comprising a chair.

22. Seating comprising:

a) a seat having left and right portions for supporting a user's left and right thighs, respectively;

b) a seat support for supporting the seat, the seat support including a pivot axis about which the left and right portions can pivot downwardly and upwardly independently relative to the seat support; and c) an exercise assembly comprising right and left foot elements positioned forwardly and below the seat to allow a user to exercise while seated, wherein the movement of the seat left and right portions and the left and right foot elements are coordinated so that when a user causes the right foot element to move upwardly or downwardly the right portion of the seat pivots correspondingly, and when a user causes the left foot element to move upwardly or downwardly, the left portion of the seat pivots correspondingly, wherein each foot element is pivotable on its own pivot axis that is different than the pivot axis of the seat support.

23. The seating of claim 22 comprising an understructure supporting the seat support.

24. The seating of claim 22 comprising a back support extending upwardly above the seat.

25. The seating of claim 24 wherein the foot elements can be maintained in a locked position to allow a user to push the pelvis of the user rearwardly into the back support.

26. The seating of claim 23 wherein the exercise assembly is connected to the understructure.

27. The seating of claim 26 wherein the exercise assembly is rigidly attached to the understructure.

28. The seating of claim 22 wherein the foot elements are mounted for reciprocating movement.

29. The seating of claim 22 wherein the connection structure is adapted so that the distance between the foot elements and the seat is adjustable.

30. The seating of claim 23 comprising a connecting element having an adjustable length connecting the foot elements to the understructure.

* * * * *